US006913656B2

(12) United States Patent
Tridib et al.

(10) Patent No.: US 6,913,656 B2
(45) Date of Patent: Jul. 5, 2005

(54) HIGH GOLD ALLOY FOR PORCELAIN FUSED TO METAL DENTAL RESTORATIONS

(75) Inventors: Dasgupta Tridib, Williamsville, NY (US); Clyde Ingersoll, Tonawanda, NY (US)

(73) Assignee: Ivoclar Vivadent, Inc., Amherst, NY (US)

( * ) Notice: Subject to any disclaimer, the term of this patent is extended or adjusted under 35 U.S.C. 154(b) by 0 days.

(21) Appl. No.: 10/638,833

(22) Filed: Aug. 11, 2003

(65) Prior Publication Data

US 2005/0036901 A1 Feb. 17, 2005

(51) Int. Cl.[7] ..... C22C 5/00

(52) U.S. Cl. ..... 148/430; 420/508; 420/509; 420/510

(58) Field of Search ..... 148/430; 420/508–510

(56) References Cited

U.S. PATENT DOCUMENTS

| | | | | |
|---|---|---|---|---|
| 3,052,982 A | | 9/1962 | Weinstein et al. | |
| 3,981,723 A | | 9/1976 | Tuccillo | |
| 4,123,262 A | | 10/1978 | Cascone | |
| 4,205,982 A | | 6/1980 | German | |
| 4,387,072 A | | 6/1983 | Schaffer | |
| 4,997,723 A | * | 3/1991 | Tanaka | 428/606 |
| 5,423,680 A | | 6/1995 | Prasad | |
| 5,431,875 A | | 7/1995 | Cameron et al. | |
| 5,462,437 A | | 10/1995 | Prasad et al. | |
| 5,799,386 A | | 9/1998 | Ingersoll et al. | |
| 5,922,276 A | | 7/1999 | Cascone | |

FOREIGN PATENT DOCUMENTS

| | | | |
|---|---|---|---|
| AU | 8927679 | * | 7/1990 |
| DE | 44 19 408 C1 | | 6/1994 |
| DE | 19607104 | * | 3/1997 |
| JP | 61067731 | * | 4/1984 |
| JP | 01132728 | * | 5/1989 |
| JP | 02190429 | * | 7/1990 |

* cited by examiner

*Primary Examiner*—Sikyin Ip
(74) *Attorney, Agent, or Firm*—Nixon Peabody LLP

(57) ABSTRACT

An alloy is provided for dental porcelain fused to metal restorations, having a rich gold color and light oxide coating for bonding the porcelain to the cast alloy substrate. The alloy has suitable mechanical properties for the support of the porcelain and is readily polished to a bright sheen. The alloy includes from 96 to 98 weight % Au with up to 3 weight % Pt, Pd, Ru, Ir, or combinations thereof and 0 to 1.5 wt % In, Sn, Fe, Mn, Cu, B, or combinations thereof.

8 Claims, No Drawings

HIGH GOLD ALLOY FOR PORCELAIN FUSED TO METAL DENTAL RESTORATIONS

FIELD OF THE INVENTION

The present invention relates to a gold-based alloy combination for use in making cast metal dental restorations and, in particular, for alloy-porcelain (porcelain fused to metal ("PFM")) composite restorations.

BACKGROUND OF THE INVENTION

Since the late 1950s, dental crowns, bridges, and the like have been made with a composite including a cast metal substrate with a veneer of porcelain fabricated in such a manner that there is a bond between metal and porcelain such that the composite is stronger than the individual component parts.

There are several aspects to be addressed when formulating such composites. Aesthetics is one aspect to be considered. The primary reason for the use of such a composite is to reproduce the normal coloration of natural dentition. The enamel layer of healthy natural dentition is quite translucent and porcelain can be made with equal translucency. The translucency of enamel allows the color of healthy dentine to be seen. The dentine color normally has a yellowish tint. For a porcelain/alloy combination to be effective as a composite, a layer of oxide must be present on the alloy to form a bond with the porcelain. While high gold alloys may provide a suitable yellowish background for the porcelain for proper aesthetics, the alloying elements can form a dark gray to black colored oxide layer, which can screen out this underlying yellowish background color. Moreover, larger amounts of alloying elements form a colored oxide layer that can further reduce or eliminate the underlying gold color of the alloy.

Mechanical properties is another aspect to be considered. The American National Standards Institute/American Dental Association ("ANSI/ADA") specification #38 and International Organization for Standardization ("ISO") standard IS9693 require a yield strength of at least 250 megapascal ("MPa") for the alloy. To attain such strength in gold-based alloys, significant amounts of alloying elements must be added, the result being alloys of "yellow" color that are nearer to gray. It was thought necessary to provide great strength because the alloy supported porcelain, which had little strength, particularly in tension, and zero ductility. Any slight deformation of the metal can cause fracture of the porcelain layer. The minima for the standards mentioned were set on the basis of testing alloys that were being successfully used at the time of the development of the standards. Subsequently, the minimum requirement has been questioned since alloys with less than this minimum have been used successfully. Also, it has been shown that the minimum requirement for single crowns should be lower than that for crowns composed of three or more unit bridges.

An unpublished work at the University of Kiel in Germany has indicated that from 30 to 35 kilograms of force causes pain to patients while, in one instance, 75 kilograms of force caused fracture of the tooth.

Physical properties is another aspect to be considered. Although the above-mentioned standards do not require either minimum or maximum values for the coefficient of thermal expansion ("CTE"), these standards require that the CTE value be given for both porcelain and alloy. This is because the popular conception is that the coefficients of porcelain and metal should be "matched" in order to assure compatibility of the two. This concept fails to take into consideration that stresses between the two occur during cooling rather than during heating and the cooling rates of porcelain and metal vary very significantly.

It is readily understood that the solidus of the alloy must be sufficiently higher than the firing temperature of the porcelain so that the alloy is not even partially melted during firing of the porcelain.

Chemical properties is another aspect to be considered. The bonding of porcelain to metal does not occur directly between porcelain and metal, rather it occurs between porcelain and the metal oxide layer. Normal PFM procedure is to heat the cast alloy to a suitable temperature to produce a metal oxide layer on the surface of the alloy. If this oxide is not adherent to the alloy; it can be simply removed by its attachment to the porcelain. Some of the bond is simply mechanical but the primary bonding takes place as a mutual solution of metal oxide in porcelain and vice versa. If the oxide is not soluble in the porcelain and/or vice versa, no bonding takes place. When the porcelain is fired, small particles and larger particle surfaces are fused (melted) and this liquid porcelain and the metal oxide layer form a solution by either liquid or solid diffusion.

SUMMARY OF THE INVENTION

An aspect of the present invention is to provide an alloy which can be manufactured by the normal melt, cast into a bar and rolled to the required thickness as well as by the atomization and compression method of U.S. Pat. No. 5,799,386 to Ingersoll et al. entitled Process Of Making Metal Castings, issued Sep. 1, 1998, which is herein incorporated by reference in its entirety.

Another aspect of the present invention is to provide an alloy which has a rich gold color.

Another aspect of the present invention is to provide an alloy which has a solidus high enough that no fusion occurs during firing of normal porcelains.

Another aspect of the present invention is to provide an alloy which has a CTE in a range that has been shown to be compatible with porcelains.

Another aspect of the present invention is to provide an alloy which can be readily cast by normal dental procedures, and can be recast using normal dental laboratory procedures.

Another aspect of the present invention is to provide a cast alloy unit which can be ground and polished to a high shine.

Another aspect of the present invention is to provide an alloy which has a light oxide color that does not cover the underlying gold color of the alloy and the oxide thickness does not increase during the firing of the porcelain.

Another aspect of the present invention is to provide an alloy which when heated to the porcelain firing temperature, forms a thin, continuous, tenacious oxide on the surface, which enters into a bond with the porcelain.

Another aspect of the present invention is to provide an alloy which has the strength to withstand loads in excess of those that would cause pain to the patient.

Another aspect of the present invention is to provide an alloy including from 96 to 98 wt % Au, up to 3 wt % Pt, Pd, Ru, Ir, or combinations thereof, and from 0 to 1.5 wt % In, Sn, Fe, Mn, Cu, B, or combinations thereof.

Another aspect of the present invention is to provide a dental restoration including a dental porcelain composition fused to a dental alloy, the alloy including from 96 to 98 wt % Au, up to 3 wt % Pt, Pd, Ru, Ir, or combinations thereof, and from 0 to 1.5 wt % In, Sn, Fe, Mn, Cu, B, or combinations thereof.

These and other aspects of the present invention will become apparent upon a review of the following detailed description and accompanying examples which are recited herein as illustrative of the present invention but in no way limit the present invention.

DETAILED DESCRIPTION OF THE INVENTION

There are several properties exhibited by the alloy system of the present invention that make it suitable for the PFM procedure.

Color. Color is established by limiting the quantity of alloying elements. Any element added to gold dilutes or changes the gold color. Platinum group metals (Pt, Pd, Ru, and Ir) are limited to a total of up to 3 wt %, preferably from 0.5 to 3 wt %. Base metals (In, Sn, Fe, Mn, Cu, and B) are optionally added to a total of from 0 to 1.5%, preferably from 1 to 1.5 wt %. Gold color is reduced in proportion to the number and amount of additives.

EXAMPLE 1

An alloy composed of 97 wt % Au and 3 wt % Pd has a light yellow color.

EXAMPLE 2

95.5% Au, 3% Pt group metals and 1.5% base metals including copper is reddish and less gold in color.

Solidus. The minimum solidus temperature of the alloy is preferably above the firing temperature of the porcelain in order that the alloy does not start to melt during the firing of the porcelain. Thus, the minimum solidus temperature for a given alloy is a function of the firing temperature of the particular matched porcelain.

| Component | Example 3 (in wt %) | Example 4 (in wt %) |
|---|---|---|
| Au | 96.3 | 96.3 |
| Pt | 2.6 | 2.5 |
| Ir | 0.1 | 0.1 |
| In | 0.2 | 0.25 |
| Sn | 0.2 | 0.2 |
| Cu | 0.2 | 0.16 |
| Fe | 0.2 | 0.2 |
| Mn | 0.2 | 0.25 |
| B | — | 0.04 |
| Solidus | 1069° C. | 1025° C. |

Since the firing temperature of the matched porcelain for the alloy is 950° C., the alloys of Examples 3 & 4 have high enough solidus. A variety of porcelain mixtures form suitable porcelain coatings when fused to dental alloys. U.S. Pat. No. 3,052,982 to Weinstein et al., which is herein incorporated by reference in its entirety, discloses porcelain fused to metal processing techniques. The restoration may include different layers with varying differences in components and amounts of components so as to form layers exhibiting different optical and thermal properties. Suitable porcelain composites include oxides of Si, Al, K, Na, Li, Ca, Mg, Zr, Sn, Ti, Y, Ce, and Eu, leucite, pigments, glass fillers, and resins. The porcelain composites may be fused by methods known in the art, including photo-initiation, chemical curing, and thermal curing.

Coefficient of thermal expansion. The CTE of the alloy is preferably between 14.4 and 15.2 when measured between 25° C. and 500° C. This is the preferred range compatible with most porcelains for the PFM procedure.

| Component | Comparative Example 5 | Comparative Example 6 |
|---|---|---|
| Au | 98.1 | 98.15 |
| Pt | 0.495 | 0.54 |
| Ir | 0.055 | 0.06 |
| In | 0.2 | 0.2 |
| Cu | 0.3 | 0.2 |
| Ti | 0.3 | 0.3 |
| Fe | 0.1 | 0.2 |
| Mn | 0.25 | 0.25 |
| Ge | 0.1 | 0.1 |
| Zn | 0.1 | — |
| CTE | 15.33 | 14.8 |

Example 6 has an acceptable CTE, but too much gold. Comparative Example has too much gold and a CTE that is too high. Neither alloy is acceptable because they are unable to meet strength requirements.

Strength: Normal measures of strength of alloys include modulus of elasticity (stiffness) and yield strength (resistance to permanent deformation). When measuring strength of alloys of the same basis, Vickers hardness ("VH") may be used as a comparative measure of these two properties plus penetration resistance and work hardening. Thus, VH may be measured to assess strength properties without the complexity of measuring all mechanical properties. The preferred alloys exhibit the highest strength available within the composition parameters.

| Ex. | 7 | 8 | 9 |
|---|---|---|---|
| Au | 96.9 | 96.3 | 96.3 |
| Pt | 1.7 | 2.6 | 2.5 |
| Ir | 0.1 | 0.1 | 0.1 |
| In | 0.2 | 0.15 | 0.25 |
| Ag | 0.3 | 0.15 | 0.0 |
| Sn | 0.0 | 0.3 | 0.2 |
| Cu | 0.3 | 0.0 | 0.16 |
| Fe | 0.2 | 0.0 | 0.2 |
| Mn | 0.3 | 0.2 | 0.25 |
| Zn | 0.2 | 0.2 | 0.0 |
| B | 0.0 | 0.0 | 0.04 |
| HV | 48 | 70 | 100 |

Examples 7–9 relate to alloys suitable for use on single crowns with porcelain fused on the surface.

A load to failure test was used to determine the preferred strength requirements for satisfactory alloys. The alloy of Example 9 was compared with two currently commercially available prior art alloys being marketed successfully. Pressure was applied on the porcelain/alloy composite until the porcelain cracked.

| Example | Load to Fracture (KN) | SD |
|---|---|---|
| 9 | 3.28 | 0.71 |
| A | 1.64 | 0.36 |
| B | 1.65 | 0.54 |

-continued

| Example | Load to Fracture (KN) | SD |
|---|---|---|

KN = Kilo Newton
SD = Standard Deviation

Examples A and B are commercially available materials that have been in use for more than a year, with few or no problems. For a single crown application, the alloy of Example 9 compares favorably with current successful commercially available materials.

The load to failure of the alloy of Example 9 in a three-unit bridge application compared to Examples C and D which represent alloys in three-unit bridges made using materials that have been used successfully for several years is shown below.

| Example | Load to Fracture (KN) | SD | Strength Modulus (psi) | 0.2% offset Yields Strength (psi) |
|---|---|---|---|---|
| 9 | 0.792 | 0.130 | — | 23,200 |
| C | 1.120 | 0.170 | 11,000,000 | 46,500 |
| D | 1.077 | 0.102 | 13,400,000 | — |

The difference in load to failure of Example D (Modulus 13,400,000 psi) as compared to Example C (11,000,000 psi) indicates no significant difference in fracture load as a result of modulus change.

The difference in load to failure of Example C (0.2% offset yield strength 46,500 psi) as compared to Example 9 (0.2% offset yield strength 23,200 psi) indicates that there is a significant difference in fracture load as a result of yield strength change. Yield strength is the strength needed to resist permanent deformation. 0.2% offset indicates that a deformation of 0.2% is allowed in order to obtain greater precision of measurement as per ASTM. The load to failure of the alloys of the present invention is significantly higher in all cases than that that causes pain in normal mastication.

While the invention has been described in detail for the purpose of illustration, it is understood that such detail is solely for that purpose, and variations can be made therein by those skilled in the art without departing from the spirit and scope of the invention which is defined by the following claims.

What is claimed is:

1. An alloy consisting essentially of 96.3 wt % Au, 2.5 wt % Pt, 0.1 wt % Ir, 0.25 wt % In, 0.2 wt % Sn, 0.16 wt % Cu, 0.2 wt % Fe, 0.25 wt % Mn, and 0.04 wt % B.

2. A dental restoration comprising a dental porcelain composition fused to a dental alloy, said alloy consisting essentially of 96.3 wt % Au, 2.5 wt % Pt, 0.1 wt % Ir, 0.25 wt % In, 0.2 wt % Sn, 0.16 wt % Cu, 0.2 wt % Fe, 0.25 wt % Mn, and 0.04 wt % B.

3. An alloy consisting essentially of 96.3 wt % Au, 2.6 wt % Pt, 0.1 wt % Ir, 0.2 wt % In, 0.2 wt % Sn, 0.2 wt % Cu, 0.2 wt % Fe, and 0.2 wt % Mn.

4. A dental restoration comprising a dental porcelain composition fused to the alloy according to claim 3.

5. An alloy consisting essentially of 96.9 wt % Au, 1.7 wt % Pt, 0.1 wt % Ir, 0.2 wt % In, 0.3 wt % Ag, 0.3 wt % Cu, 0.2 wt % Fe, 0.3 wt % Mn, and 0.2 wt % Zn.

6. A dental restoration comprising a dental porcelain composition fused to the alloy according to claim 5.

7. An alloy consisting essentially of 96.3 wt % Au, 2.6 wt % Pt, 0.1 wt % Ir, 0.15 wt % In, 0.15 wt % Ag, 0.3 wt % Sn, 0.2 wt % Mn, and 0.2 wt % Zn.

8. A dental restoration comprising a dental porcelain composition fused to the alloy according to claim 7.

* * * * *

UNITED STATES PATENT AND TRADEMARK OFFICE

CERTIFICATE OF CORRECTION

PATENT NO. : 6,913,656 B2
DATED : July 5, 2005
INVENTOR(S) : Dasgupta et al.

It is certified that error appears in the above-identified patent and that said Letters Patent is hereby corrected as shown below:

Title page,
Item [12], should read -- United States Patent
Dasgupta et al. --.
Item [75], Inventors, should read -- Tridib Dasgupta, Williamsville, NY (US); Clyde Ingersoll, Tonawanda, NY (US) --.

Signed and Sealed this

First Day of November, 2005

JON W. DUDAS
*Director of the United States Patent and Trademark Office*